US005265806A

United States Patent [19]

Ferrarini

[11] Patent Number: 5,265,806

[45] Date of Patent: Nov. 30, 1993

[54] NOZZLE FOR THE GENERATING OF A ROTATING JET

[75] Inventor: Claudio Ferrarini, Modena, Italy

[73] Assignee: P.A. S.r.L., Rubiera, Italy

[21] Appl. No.: 971,589

[22] Filed: Nov. 5, 1992

[30] Foreign Application Priority Data

Nov. 15, 1991 [IT] Italy ..... M091A000162

[51] Int. Cl.[5] ..... B05B 3/06

[52] U.S. Cl. ..... 239/251

[58] Field of Search ..... 239/251-256, 239/240, 263, 237

[56] References Cited

U.S. PATENT DOCUMENTS

| | | | |
|---|---|---|---|
| 1,742,898 | 1/1930 | Buelna | 239/237 X |
| 2,986,394 | 5/1961 | Knight | 239/252 X |
| 4,802,628 | 2/1989 | Dautel et al. | 239/240 X |
| 4,989,786 | 2/1991 | Kranzle et al. | 239/240 |
| 5,039,013 | 8/1991 | Sawade et al. | 239/250 |
| 5,104,044 | 4/1992 | Ratell | 239/240 |

*Primary Examiner*—Andres Kashnikow
*Assistant Examiner*—Kevin Weldon
*Attorney, Agent, or Firm*—Browdy and Neimark

[57] ABSTRACT

The invention relates to a nozzle for the generating of a rotating jet. It comprises, internally to a head (1) equipped with an outlet hole (2), a rotor (3) fed by the pressurized fluid, on which a nozzle-bearing body (8) is coaxially and solidly rotatably constrained. The nozzle-bearing body (8) bears, at its free end and coupled in a seating (11) arranged coaxially to the outlet hole (2), an outlet mouth (9) which belongs to a nozzle (10) whose axis is incident at a predetermined inclination to the rotation axis.

5 Claims, 2 Drawing Sheets

NOZZLE FOR THE GENERATING OF A ROTATING JET

BACKGROUND OF THE INVENTION

The invention relates to a nozzle for the generating of a rotating jet. The use of devices for the production of rotating jets equipping water-jet cleaning machines is well known.

The prior art teaches the production of rotating jets obtained, in many cases, through the use of complicated and thus expensive mechanical solutions. For example, solutions exist which envisage the use of gear mechanisms, set in rotation by small turbines fed by the pressurised fluid itself, which mechanisms in turn set the nozzle in rotation. In other embodiments not having the said motor transmission gear mechanisms, drawbacks emerge which are in some cases due to the presence of eccentric masses in rotation, which require special constructional specifications, in other cases due to the difficulty of realising simple and efficient sealing devices.

SUMMARY OF THE INVENTION

The present invention, as it is characterised in the claims, obviates the prior-art drawbacks and inconvenients by providing a device for producing a rotating jet which is structurally simple, being composed of only a small number of parts, and thus easy to mount and dismount and realisable, at least in the main, with relatively cheap materials. A further aim of the present invention is to equip the nozzle with a device, activatable simply and manually from the outside, by means of which it is possible to "brake" the rotation of the jet or even fix it in one position.

BRIEF DESCRIPTION OF THE DRAWINGS

Further characteristics of the present invention will better emerge from the detailed description that follows, made with reference to the accompanying drawings, which represent some preferred embodiments here illustrated in the form of a non-limiting example, and in which.

DESCRIPTION OF THE PREFERRED EMBODIMENTS

Figure 1:
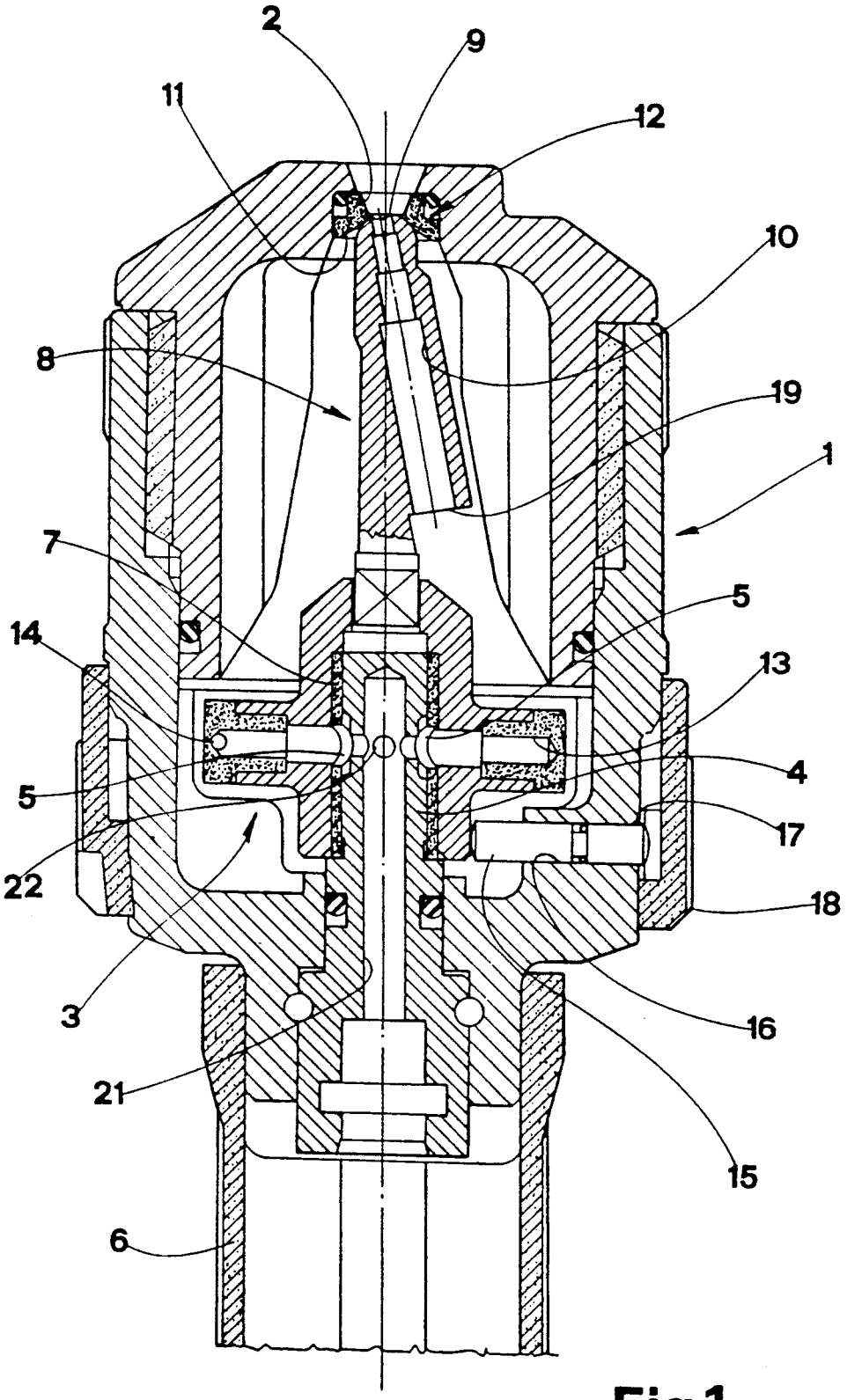
FIG. 1 shows a schematic longitudinal section of the invention.

With reference to the figures, 1 denotes a fixed head at the end of a lance 6 of a water-jet cleaning machine. The head 1 is equipped with an outlet hole 2 bored in an annular insert 12 sealedly fixed on the body of the selfsame head 1. The axis of the outlet hole 2 coincides with the lance 6 axis and also with that of a fixed pivot 4, on which fixed pivot 4 a rotor 3 is rotatably mounted, with the interpositioning of plain bearing 7. The fixed pivot 4 exhibits a coaxial hole 21 constituting a feeding conduit by means of which the pressurised fluid (water) is sent, through the lance 6, to the head 1. By means of the radial holes 22 the hole 21 is placed in direct communication with an external annular channel 5 arranged at the external cylindrical surface of the fixed pivot 4 and the plain bearing 7. The inlet mouths of radial channels 13 arranged in the rotor 3 face on to the external annular channel 5. Each radial channel 13 has an outlet mouth 14 which axis is perpendicular to that of the channel 13 itself. All of the outlet mouths 14 are arranged in such a way that the reactions on the rotor 3 due to the exit of the pressurised liquid from the outlet mouths 14 themselves generate equal moment with respect to the rotation axis. The rotor 3 is coaxially constrained, with a coupling establishing only solidarity of rotation about the common axis, with a nozzle-bearing body 8. The nozzle-bearing body 8 exhibits, at its free end, an outlet mouth 9 of a nozzle 10 exhibiting its axis incident to and arranged at a predetermined incidence to the rotation axis. The nozzle 10, having a straight axis, has its liquid inlet mouth 19 coaligned with the outlet mouth 9, in direct communication with the chamber described internally to the head 1 downstream of the rotor 3. The free end of the nozzle-bearing body 8 is shaped so as to couple on contact with a seating 11 made in the annular insert 12 and is constituted by a portion of revolution surface coaxially predisposed at the outlet hole 2. The nozzle-bearing body 8 is freely-rotatably coupled with the rotor 3 along the common axis by means of a movable connection of the sliding type. Contact between the end of the nozzle-bearing body 8 and the seating 11 is caused and maintained by the pressure exerted by the fluid present internally to the head 1 on the nozzle-bearing body 8 itself. In the embodiment illustrated in FIG. 2, the free end of the said nozzle-bearing body is occupied by a tubular element 28 made in stainless steel and is stably coupled in a hollow seating 29 bored coaxially in the nozzle 10.

The tubular element 28 is equipped with a cylindrical part, by means of which it is coupled with the hollow seating 29, and has a shaped end suitable to come into contact with the seating 11, made of plastic material, which is made in the annular insert 12.

The outlet mouth 39 is coaligned with the liquid inlet mouth 19 and is arranged at the free end of the tubular element 28, and is in communication with the central part of the nozzle 10 by means of a coaxial conduit 30.

A fan 31 is arranged in the initial part of the said nozzle 10, immediately downstream of the liquid inlet mouth 19.

The presence of the tubular element 28, made in stainless steel and coupled with the annular insert 12, which is made of plastic, permits of good dispersion of the thermal energy created by the rubbing of the shaped end of the tubular element 28 against the seating 11.

Figure 2:
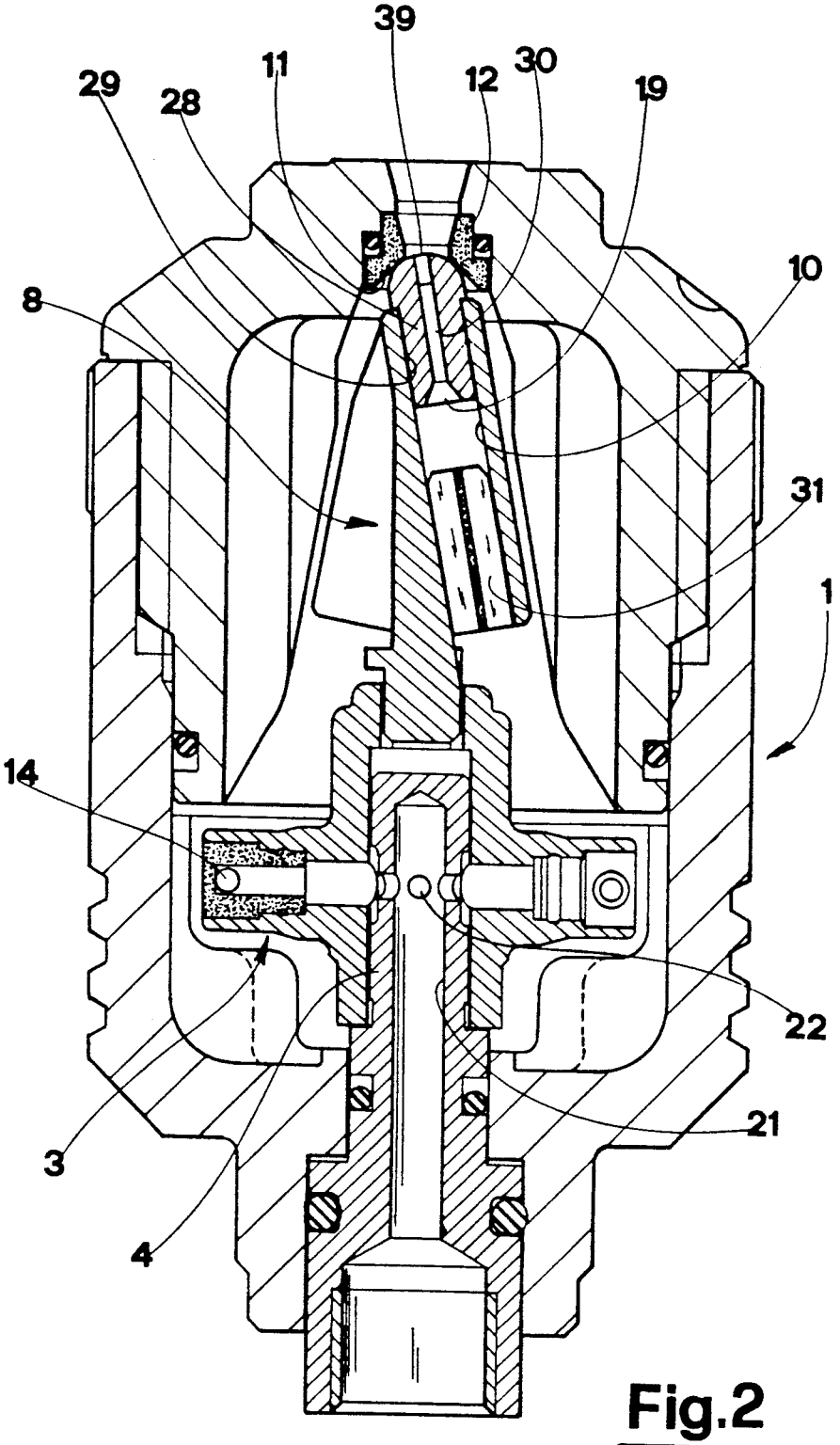
FIG. 2 shows, in enlarged scale, part of a section, being the same section as in FIG. 1, relative to a further embodiment.

In the embodiment illustrated in FIG. 2, the plain bearing 7, operating between the fixed pivot 4 and the rotor 3 of the first embodiment is not present.

The entire rotating group constituted by the rotor 3 and the nozzle-bearing body 8 is coaligned along the said rotation axis. The pressurised liquid enters the hole 21 and before exiting to the outside, directed by the nozzle 10, it passes through the conduits of the rotor 3, causing the latter's rotation. This rotation movement is then solidly and coaxially transmitted to the nozzle-bearing body 8. Once the rotor 3 has been crossed, the liquid can exit to the outside only through the nozzle 10 made in the nozzle-bearing body 8 and solidly drawn in rotation by the rotor 3.

The rotation can be "braked" or even completely stopped by means of a device, manoeuvrable from the outside, which acts as a sort of brake on the entire rotating group. The device comprises a cylindrical element 15 sealedly housed, with sliding possibility in radial direction, in a through-seating 16 made radially on the body of the head 1. The cylindrical element 15 exhibits a first end, the one contained internally to the head 1, predisposed to come into contact with an external cylindrical surface of the body of the rotor 3. The other end, the one located externally to the head 1, is predisposed to interact on contact with a sort of cam or ramp 17 made in an annular ferrule 18, coaxially coupled with rotation possibility externally to the head 1. The device very simply permits, through a rotation imposed on the ferrule 18, of pushing the cylindrical element 15 against the external cylindrical surface of the rotor 3 up until it exerts on the said rotor 3 a pressure which is sufficient to stop its rotation. The freedom to rotate is reinstated, obviously, with a contrary-sense movement of the ferrule 18, which frees the element 15 to slide axially.

What is claimed is:

1. A nozzle for generating a rotating jet, said nozzle comprising:

a head (1) having an outlet hole (2), a mobile group rotatably mounted around an axis of rotation within said head and coaxially with said outlet hole (2), said mobile group having a rotor mounted on a fixed pivot (4), said fixed pivot (4) having a feeding conduit (21) arranged coaxially with said outlet hole for transmission of pressurized fluid, an external annular channel (5) on said fixed pivot communicating with said feeding conduit (21), said annular channel opening into an internal space of a hub of said rotor (3) for distribution of pressurized fluid through passages (13, 14) in said rotor (3) to a chamber internal of said head and downstream of said rotor, a nozzle-bearing body (8) integrally joined to said rotor (3) coaxially with said axis of rotation, an outlet mouth (9, 39) located at a free end of a nozzle (10) bored through said nozzle-bearing body (8), the axis of said nozzle being inclined at a predetermined fixed angle to said axis of rotation, said nozzle (10) having a liquid inlet mouth (19) coaligned with said outlet mouth (9,39), said inlet mouth opening on said chamber, and seating means engaged to said head (1) between said outlet hole (2) and said nozzle-bearing body (8) to provide sealed rotation of said nozzle and communication of said outlet hole (2) and said outlet mouth (9,39) when pressurized fluid is being discharged from said nozzle.

2. A nozzle as in claim 1, wherein said nozzle-bearing body (8) and said rotor are slidably and freely coupled to said fixed pivot (3) along a common axis by a movable connection.

3. A nozzle as in claim 1, wherein said seating means is (11) formed on in an axial-symmetric annular insert (12) coaligned with said axis of rotation and sealedly fixed on said head (1).

4. A nozzle as in claim 1, wherein a free end of said nozzle-bearing body (8) is occupied by a tubular element (28) which is made of stainless steel and which is stably engaged in a hollow seating (29) arranged coaxially in said nozzle (10); said tubular element (28) being equipped with a coaxial conduit (30) which leads to an outlet mouth (39) at a free end of said tubular element, said free end being shaped so as to engage with said seating means (11) formed in an annular insert (12) fixed in said head (1) and made in a plastic material.

5. A nozzle as in claim 1, comprising a device, maneuverable externally, for braking said rotor (3); said device comprising a cylindrical element (15) sealedly housed, with possibility of radial-direction sliding, in a through-seating (16) made radially in said head (1) and further being equipped with a first end which is predisposed to come into contact with a tract of external cylindrical surface of said rotor (3); another end of the said cylindrical element (15) being predisposed externally to said head (1) to interact with a cam or ramp (17) made in a ferrule (18) which is coaxially coupled, with relative rotation possibility, to said head (1).

* * * * *